US006176950B1

(12) United States Patent
Wood et al.

(10) Patent No.: US 6,176,950 B1
(45) Date of Patent: Jan. 23, 2001

(54) AMMONIUM NITRATE AND PARAFFINIC MATERIAL BASED GAS GENERATING PROPELLANTS

(76) Inventors: James C. Wood; Ernest H. Wood, both of 395 N. Perry Pwky. #04, Perry, GA (US) 31069

( * ) Notice: Under 35 U.S.C. 154(b), the term of this patent shall be extended for 0 days.

(21) Appl. No.: 09/313,134

(22) Filed: May 17, 1999

(51) Int. Cl.[7] ..... C06B 45/10; C06B 31/28; C06B 25/34

(52) U.S. Cl. ..... 149/19.1; 149/46; 149/92

(58) Field of Search ..... 149/2, 3, 6, 7, 149/19.1, 45, 46, 47, 92

(56) References Cited

U.S. PATENT DOCUMENTS

| | | | | |
|---|---|---|---|---|
| 3,779,821 | * | 12/1973 | Fujiki et al. | 149/7 |
| 3,966,853 | * | 6/1976 | Osako et al. | 264/13 |
| 4,736,683 | * | 4/1988 | Bachman et al. | 102/290 |
| 5,041,177 | * | 8/1991 | Hajto et al. | 149/5 |
| 5,567,910 | * | 10/1996 | Chattopadhyay | 149/3 |
| 5,989,367 | * | 11/1999 | Zuener et al. | 149/47 |

* cited by examiner

*Primary Examiner*—Charles T. Jordan
*Assistant Examiner*—Aileen J. Baker
(74) *Attorney, Agent, or Firm*—Stratton Ballew PLLC

(57) ABSTRACT

An ammonium nitrate and paraffinic material based gas generating composition is provided. The gas generating composition includes ammonium nitrate as a oxidizer, mixed with a paraffinic material as a fuel. Examples of paraffinic material include paraffin wax, and broadly includes polyolefins. Polyolefins include polyethylene, polypropylene and polybutylene. Additionally, as alternatives, the gas generating composition of the present invention can also include a small quantity of magnesium stearate, potassium perchlorate or alternatively, RDX. The ammonium nitrate oxidizer, the paraffinic material fuel and the additional alternative components are combined and mixed in a predetermined stoichiometric ratio. The gas generating composition is devoid of metal oxides and produces virtually no particulate and slag upon ignition. It also produces an acceptable, low level of undesirable trace effluents such as carbon monoxide, and nitric oxide, both of which are inherently present in nonazide gas generating compositions. The gas generating composition is environmentally friendly after the deployment of the gas generant and abrasive damage to the tooling used in the manufacture of the gas generating composition is minimized.

14 Claims, 2 Drawing Sheets

AMMONIUM NITRATE AND PARAFFINIC MATERIAL BASED GAS GENERATING PROPELLANTS

TECHNICAL FIELD

The present invention relates generally to an ammonium nitrate and paraffinic material based gas generating composition used to inflate passive restraint systems. More specifically, the present invention relates to a gas generating composition which, unlike any current metal-oxide, non-metal-oxide or non-azide based gas generant, can be tailored and manufactured to meet or exceed the mandated specifications of government regulatory agencies, such as the FAA, NTSB, and NHITSA.

BACKGROUND OF THE INVENTION

Gas generating compositions are extremely useful in the automotive passive restraint (air bag) industry, although other uses, such as commercial or military aircraft applications, are contemplated for such gas generating compositions. Today, most, if not all, new automobiles are equipped with single or multiple air bags to protect the driver and passengers. In the near future it is expected that aircraft manufacturers will be under similar government mandates. In the operation of air bags, sufficient gas must be generated to inflate the device in a fraction of a second. The air bag must fully inflate between the time that the automobile is impacted in a collision, and the time the driver or passenger would otherwise be thrust forward against the steering wheel, dashboard or sideways against the door of a vehicle or aircraft. Consequently, nearly instantaneous gas generation is required.

There are a number of mandated design specifications required by automobile manufacturers and other regulator agencies that must be adhered to in the preparation of gas generating compositions. One such required specification is that the composition produces gas at a specific rate. Automobile manufacturers require that the gas be generated at a sufficiently and reasonably low temperature so that the occupants of the involved automobile are not burned upon impacting an inflated air bag. Inconsistent ballistic output is a major problem with all pyrotechnic inflators. Accordingly, a need exists for a formulation that minimizes the ballistic variability, prevents the production of excessive heat and maintains an adequate burn rate while generating the cleanest possible gas required to fill the specified air bag's internal envelope.

Another specified requirement of the automobile manufacturing industry is that gas generating compositions strictly limit the generation of toxic gases or solids such as but not limited to carbon monoxide, carbon dioxide, nitrogen oxide, sulfur oxide, and hydrogen sulfide. Another related design requirement is that the gas generant composition produces a limited quantity of particulate materials, which can interfere with the operation of the passive restraint system, create an inhalation hazard, irritate the skin and eyes, or present a hazardous solid waste that must be disposed of in an environmentally safe manner.

Sodium azide is one such hazardous constituent of gas generating compositions that is currently being phased out by the industry due to its high toxicity as taught in U.S. Pat. No. 6,661,261 to Ramaswamy, et al. and U.S. Pat. No. 5,516,377 to Highsmith, et al. Further, the use of sodium azide (or other azides) results in extra expense and risk in manufacture of gas generant due to the extreme toxicity of azides.

It has also been found that the non-azide propellant technologies are costly to manufacture, and have inherent performance problems such as high burn temperature, undesirable trace effluent values and inconsistent ballistic output. High burn temperatures are undesirable because the gas requires more cooling to maintain acceptable gas temperatures. Cooling of the gas is typically performed by the inflator filtration system. A disadvantage of the filter is that it also increases material costs. On the other hand, the baffle system minimizes cost. Cool gas temperatures, however, are required to prevent the air bag and subsequently the occupant of the automobile or aircraft from burning.

It would be preferable, therefore, to have a gas generating composition that produces more gas and fewer solids. The nongaseous fraction of the gas generant products must be contained or filtered to provide a clean inflating gas. It would also be desirable that when the composition produces particulates, the majority of these particulates are filterable, solid slag. When conventional gas generating compositions that included a combination of 5AT and a metal oxide were detonated, it was observed that significant quantities of slag formed as a byproduct. The term slag is herein defined as insoluble metallic particulate. This slag was generated in addition to the gasses generated by the ignition of the gas generating composition containing the metal oxide. Slag can be easily filtered, preventing the airborne reaction products from escaping into the surrounding environment during and after air bag deployment. Filtration, therefore, serves a function that limits the dissipation of potentially harmful dust in the vicinity of the spent air bag, which could otherwise cause secondary effects to the passengers and others in the vicinity such as eye, lung, and mucous membrane irritation.

Currently available 5AT based gas generating compositions form a minimum of water-soluble products at combustion of the gas generating composition form a minimum of water-soluble products at combustion of the gas generant. For example, U.S. Pat. No. 5,500,059 to Lund, et al. teaches that copper oxide is a preferred oxidizer in SAT based gas generating compositions. U.S. Pat. No. 5,139,588 to Poole teaches the use of transition metal oxides and other metal oxides having high melting points in 5AT based gas generating compositions to function as high temperature slag forming material.

The utilization of waxes in ballistic formulation is taught in several U.S. patent references. Examples include U.S. Pat. No. 4,315,787 to Hattori, which suggests the use of wax or oil to create a separate, stable phase in a water mixture. The two phases of the emulsion are combined upon impact, causing detonation. In Hattori '787, the wax is taught to be a combustible substrate at 1% to 7% of the compound. The U.S. Pat. No. 4,394,198 to Takeuchi also teaches the use of an oil or wax material as a combustible element in a two-phase mixture. In Takeuchi '198 the wax or oil is taught to amount to 1% to 10% of the total composition. The U.S. Pat. No. 4,500,369 to Tag discloses another variation on the water-in-oil explosive mixture, where 2% to 6% of wax is added.

For other than two-phase explosive mixtures, the U.S. Pat. No. 4,736,638 to Bachman teaches the addition of a high molecular weight polymer to an ANFO (ammonium nitrate and fuel oil) explosive mixture. A small amount (approximately 0.1%) of the polymer is added to the ANFO to change the viscosity and detonation properties of the mixture. The U.S. Pat. No. 5,597,977 Chattopadhyay discloses the hardening of ammonium nitrate (AN) with a polymer additive, such as polystyrene. Chattopadhyay '977 teaches the addition of up to 10% of the polymer. Chattopadhyay '977 directs his application toward the hardening of the AN. The U.S. Pat. No. 5,641,938 to Holland teaches a gas generating composition that includes an elastomeric binder. Holland '938 specifically directs his invention to non-azide air bag inflation applications. However, the binders disclosed are only plasticizers that comprise up to about 10% of the total mixture. Holland '938 teaches the use of nitroguanidine as a primary fuel.

The primary purpose of the waxes and plastics, especially in water free mixtures, relates to the binding properties that smaller quantities of the plastic materials impart to the mixture.

SUMMARY OF INVENTION

The present invention provides an ammonium nitrate and paraffinic material based gas generating composition. The gas generating composition of the present invention includes ammonium nitrate as an oxidizer, mixed with a paraffinic material as a fuel.

The paraffinic material that constitutes a small portion of the composition, and is utilized as the fuel component of the compound. Paraffinic material is herein defined as a hydrocarbon, either synthetic or naturally occurring, that includes only carbon and hydrogen in its structure and is substantially solid at standard conditions. Examples of paraffinic materials include paraffin waxes and polyolefins. Polyolefins include polyethylene, polypropylene and polybutylene.

The gas generating composition of the present invention can also include a small quantity of magnesium stearate, as an additional component to aid in the processing and forming of the gas generating composition. Also alternatively, the gas generating composition of the present invention can include the additional components of potassium perchlorate or alternatively RDX. Potassium perchlorate is an oxidizer, while RDX is an energetic fuel, technically referred to as hexahydro-1,3,5,-trinitro-1,3,5-triazine.

The ammonium nitrate oxidizer, the paraffinic material fuel, and any additional alternative components are combined and mixed in a predetermined stoichiometric ratio, Standard mixing equipment for mixing energetic solids of these types that are well known to those who have skill and knowledge of this art is utilized in the manufacture of the gas generating composition of the present invention.

As discussed above, the ignition of a gas generating composition that included a combination of 5AT and a metal oxide, produced significant quantities of slag. This slag was generated in addition to the gasses generated by the ignition of the gas generating composition containing the metal oxide. The present invention produces minimal quantities of slag. It is therefore an advantage of the present invention to provide a gas generating composition that is devoid of metal oxides and produces virtually no particulate or slag.

Another advantage of the present invention is to provide a gas generating composition that produces an acceptable, low level of undesirable trace effluents such as carbon monoxide and nitric oxide, both of which are inherently present in non-azide gas generating compositions.

A further advantage of the present invention is to provide a gas generating composition that minimizes the ballistic variability through the inherent consistency in the formulation of the gas generating composition of the present invention.

Another advantage of the present invention is to provide a gas generating composition that is environmentally friendly after the deployment of the gas generant.

A related advantage of the present invention is to provide a gas generating composition that yields approximately 99 volume percent of inert, nonhazardous gases.

A further advantage of the present invention is to provide a gas generating composition that minimizes abrasive damage to the tooling used at the pelletization stage in the manufacture of the gas generating composition for use in a passive restraint system.

A still further advantage of the present invention is to provide a gas generating composition with higher gas yields, which permit a smaller inflator and eliminates or drastically reduces the need for a filter in the inflator. The ammonium nitrate and paraffinic material based propellant does not require filtration to eliminate particulate because this propellant formulation does not generate particulate. This propellant only requires a baffle to cool the gas and redirect the flow of the gas.

Another advantage of the present invention is to provide a gas generating composition that has a significantly lower burn temperature than conventional non-azide compositions.

An additional advantage of the present invention is to provide a gas generating composition that can be mass produced using a dry or wet manufacturing process.

A further advantage of the present invention is to provide an improved method for making a passive restraint system.

Additional features and advantages of the present invention are described in and will be apparent from the detailed description of the presently preferred embodiments and from the drawings.

DETAILED DESCRIPTION OF SPECIFIC EMBODIMENTS

Figure 1:
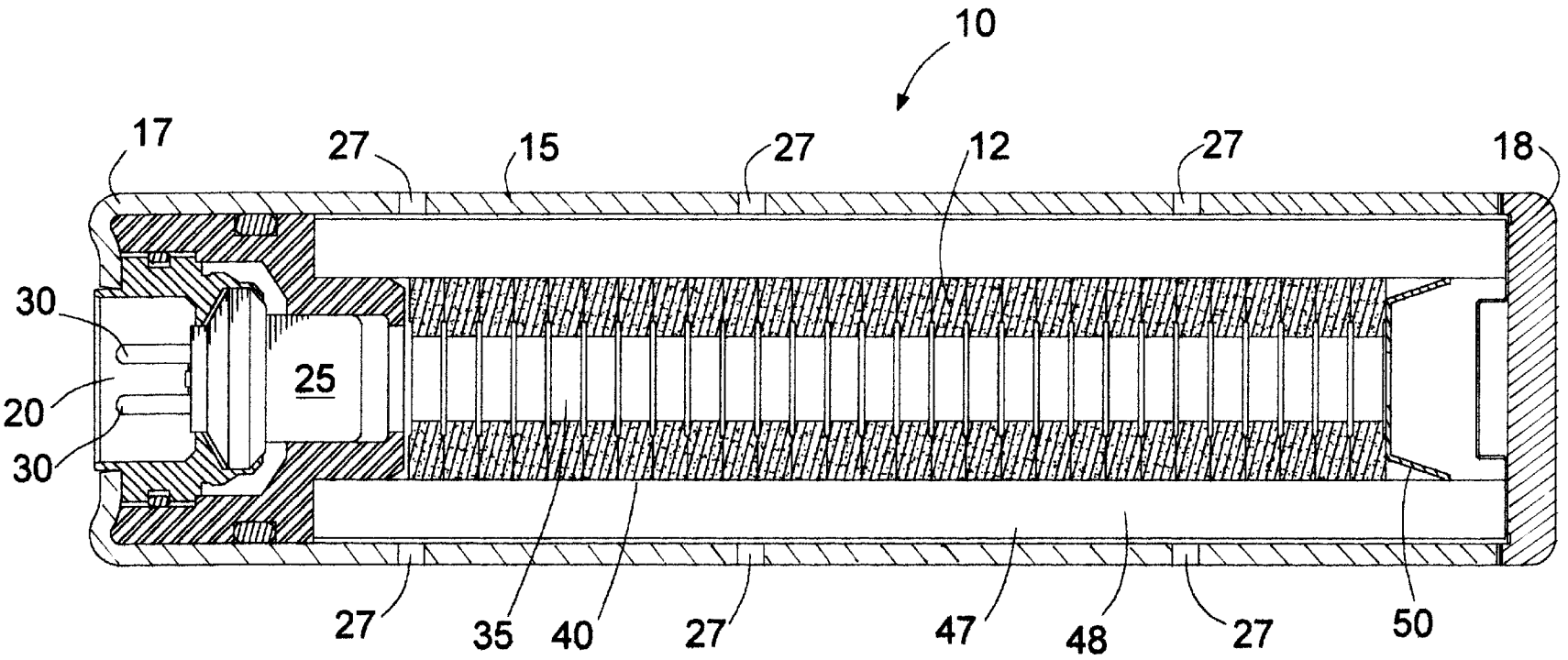
FIG. 1 is a partially sectioned view of a gas-generating device in accordance with a preferred embodiment of the invention.

The present invention provides a gas generating composition that is formulated to minimize the yield of noxious effluents. The gas generating composition of the present invention includes ammonium nitrate as an oxidizer, mixed with a paraffinic material as a fuel. Examples of a paraffinic materials include paraffin waxes, having the structure ($C_n$—$H_{2n+2}$). These paraffin waxes maybe refined or unrefined, however the refined and purified. For the purposes of the present invention, the term "paraffinic materials" is broadly interpreted to include polyolefins. Polyolefins are a group of plastic materials that are essentially straight-chain, high molecular weight hydrocarbons that approximately conform to the structure (—$C_n$—$H_{2n}$—). Polyolefins include the related series of plastics: Polyethylene, which approximately has the structure (—$CH_2$—$CH_2$—); polypropylene, which approximately has the structure [—$CH_2$—$CH(CH_3)$—]; and polybutylene, which approximately has the structure [—$CH_2$—$CH(CH_2$—$CH_3)$—]. This polyolefin series can be extended to include any saturated polymer that includes only carbon and hydrogen.

The selection of the oxidizers was achieved by the experience and knowledge of the inventors in the field of the present invention. The gas generating compound of the present invention includes ammonium nitrate as an oxidizer. Ammonium nitrate was selected as an oxidizer because of its high nitrogen content. Substantially all of the nitrogen in the ammonium nitrate is reduced by the reaction to form a nitrogen gas, having the structure ($N_2$).

The gas generating composition of the present invention can also include a small quantity of magnesium stearate. Magnesium stearate helps the powdered formulation of the gas generating composition to maintain the pelletized form for use in gas generating devices. Also alternatively, the gas generating composition of the present invention can include potassium perchlorate. Potassium perchlorate is, an oxidizer that the inventors have found exceptionally compatible with ammonium nitrate.

Alternatively to the potassium perchlorate, the inventors consider the addition of RDX to the gas generating composition of the present invention. RDX is an energetic fuel, technically referred to as hexahydro-1,3,5,-trinitro-1,3,5-triazine. RDX is also technically referred to as cyclotrimethylene-trinitroamine, and is also commonly referred to as cyclonite, or hexogen. RDX is utilized as a "kicker" or accelerant for the gas generating compound. RDX has a high degree of stability in storage and is often employed in explosive ordnance mixtures by the military. The inventors of the present invention conceive that a small amount of RDX, preferably from 0.5% to 5% by weight, will improve the ignition properties of the gas generating composition of the present invention. Most preferably, 1% RDX will be employed in an alternative embodiment of the present invention.

The ammonium nitrate oxidizer, the paraffinic material fuel, and any additional alternative components are combined and mixed in a predetermined stoichiometric ratio. The empirically calculated ratio of ingredients is the ideal and preferred mixture to be employed by the inventors, as listed in the examples detailed herein.

Importantly, the ammonium nitrate and paraffinic material formulation of the present invention does not generate enough particulate to require a filter. All that is required is a baffle that cools the gas and diverts the gas flow to prevent non-cooled gas from entering the bag which can cause damage to the bag and possibly bum the occupant of the car.

Also importantly, the gas generating composition of the present invention burns at a substantially lower temperature than 5AT formulated compounds. 5AT compound can generate temperatures in excess of 3,600° F., while the gas generating compound of the present invention generates temperature of approximately 2,800° F. This significant reduction in ignition temperature results in a much lower gas temperature, which is easier to cool, via routing through baffles and filters, to a temperature that is safe for inflation of the airbag.

As shown in FIG. 1, an exemplary gas-generating device 10 is shown which may be employed with the gas generating composition 12 of the present invention. The gas-generating device includes a body 15 having a first end 17 and a second end 18. The first end of the body has an aperture 20 for receiving an initiator assembly 25. The body preferably also includes a plurality of apertures 27 to allow the gas generated within to escape into an inflating air bag (not shown).

To ignite and combust the gas generating composition 12, a crash sensor (not shown) closes an electrical circuit, or initiates a firing signal which activates the initiator assembly 25. The initiator assembly contains a small explosive charge (not shown) or pyrotechnic composition designed to produce a heat flash of sufficient intensity to ignite the gas generating composition. The initiator also includes two electrodes 30; each insulated from one another and connected by a bridge wire (not shown). The bridge wire is preferably embedded in the small explosive charge. The inventors preferably utilize zirconium potassium perchlorate (ZPP) as the small explosive charge within the initiator assembly. However, any such pyrotechnic material known to those who have skill and knowledge in this art could be used.

As also shown in FIG. 1, the exemplary gas-generating device 10 includes a central core cavity 35 positioned within the perforated tube 40 and surrounded by the gas generating composition 12. The initiator assembly 25 ignites the gas generating composition by sending a heat flash down the central core cavity to contact and ignite the gas generating composition. The gas generating combustion is preferably surrounded by a perforated tube 40 of low carbon steel.

Figure 3:
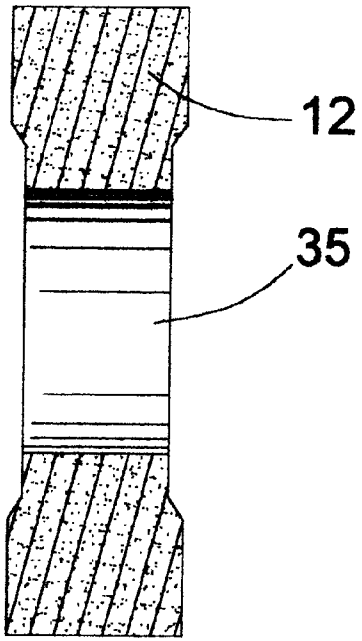
FIG. 3 is a sectioned view of the solid geometric form of a gas generating composition, taken along section line 3—3 of FIG. 2
Figure 2:
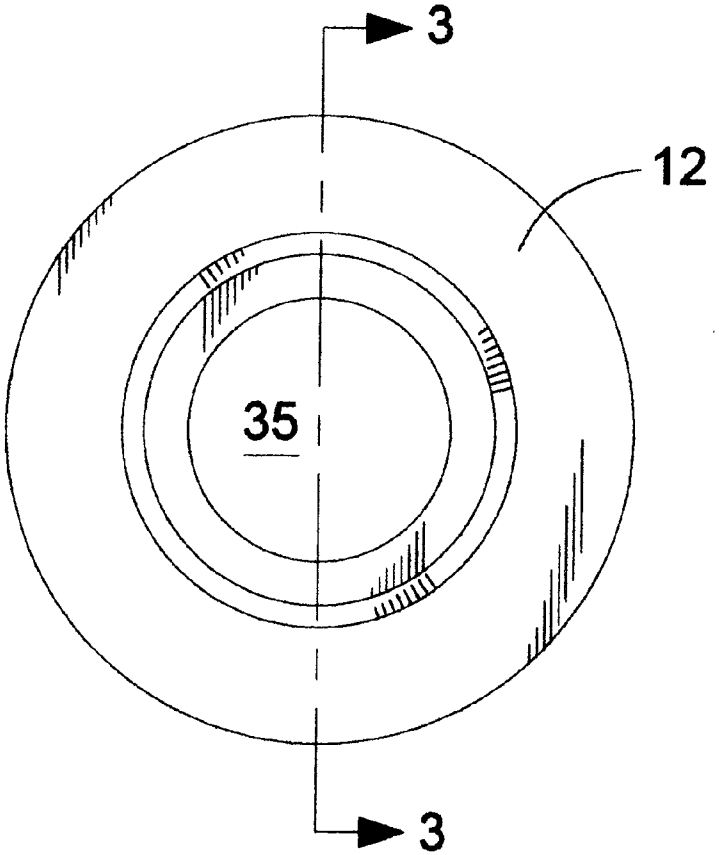
FIG. 2 is a top view of a solid geometric form of a gas generating composition in accordance with a preferred embodiment of the invention.

FIG. 2 shows a solid form of the gas generating composition 12 in a geometric shape that is preferred for use in the exemplary gas generating device 10, shown in FIG. 1. The preferred geometric shape as shown in FIG. 2 includes the central core 35 for receiving the heat flash from the initiator assembly 25. FIG. 3 shows a section of the preferred geometric shape of the gas generating composition of FIG. 2, which is similar to the view shown in FIG. 1. The preferred geometric shape of the gas generating composition is stacked together within the gas-generating device as detailed in FIG. 1. The geometric shape's physical parameters, such as the exact diameter, thickness, and length of the central core cavity can be varied to suit the specific qualities of the desired dynamics for combustion and gas generation, as required.

As also detailed in the exemplary gas generating device 10 shown in FIG. 1, a propellant retainer 50 preferably maintains the position of the gas generating composition 12 until the gas generating device is fired. When ignited, the rapidly expanding gas from the gas generating composition escapes through the perforated tube 40, to finally emit from the plurality of apertures 27 in the body 15 of the gas generating device. An air bag (not shown) or a similar device can then be quickly inflated with the gas thus generated.

The following prophetic examples illustrate the gas generating compound 12 of the present invention, but are not intended to specifically limit the invention. These examples would be performed by igniting the gas-generating compound within the exemplary gas generator 10 as described herein. Furthermore, a conventional test device would be configured to include the exemplary gas generator mounted to expel the gas generated into a 60-liter tank.

The following four examples employ the preferred embodiments of the present invention. The examples are all prophetic, in that empirical calculations, and the experience of the inventors in the chemistry, combustion characteristics and the manufacture of gas generants for airbags, were the primary tools employed to formulate the following examples and expected tabulated results.

EXAMPLE 1A

A gas generating composition containing, by weight, 93% ammonium nitrate, 6% purified paraffin wax and 1% magnesium stearate would be prepared by standard dry process. The process includes mixing the above listed components, followed by compaction and screening and finally pressing them into formed pellets, preferably in the form as shown in FIGS. 2 and 3. The pellet is preferably processed in an auger type aspirin press, modified to form the preferred pellet. The formed pellets are then tested by combusting a multiple pellet charge in the test device as previously described herein. The test inflators include initiators loaded with 90 mg–270 mg ZPP. After ignition and burning, gaseous products of the combustion are analyzed. The approximate and expected 30 minute time averaged concentrations of the gaseous samplings in ppm by volume, are illustratively set forth in Table IA below, as determined by infrared spectroscopy:

TABLE IA

| Concentration of Ignition Products for Example 1A (in ppm by volume) | |
|---|---|
| Carbon Monoxide | 100 |
| Carbon Dioxide | 1000 |
| Nitric Oxide | <1 |
| Nitrogen Dioxide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Sulfur Dioxide | <1 |
| Particulate | 0.1g |

EXAMPLE 1B

A gas generating composition containing, by weight, 93% ammonium nitrate, 6% poly ethylene and 1% magnesium stearate would be prepared by standard dry process. The process includes mixing the above listed components, followed by compaction and screening and finally pressing into formed pellets, preferably in the form as shown in FIGS. 2 and 3, by processing in an auger type aspirin press, modified to form the preferred pellet. The formed pellets are then tested by combusting a multiple pellet charge in the test device as previously described herein. The test inflators include initiators loaded with 90 mg–270 mg ZPP. After ignition and burning, gaseous products of the combustion are analyzed. The approximate, expected 30 minute time averaged concentrations of the gaseous samplings in ppm by volume, are illustratively set forth in Table IB below, as determined by infrared spectroscopy:

TABLE IB

| Concentration of Ignition Products for Example 1B (in ppm by volume) | |
|---|---|
| Carbon Monoxide | 150 |
| Carbon Dioxide | 950 |
| Nitric Oxide | <1 |
| Nitrogen Diozide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Sulfur Dioxide | <1 |
| Particulate | 0.1g |

EXAMPLE 2A

A gas generating composition containing, by weight, 88% ammonium nitrate, 6% purified paraffin wax, 5% potassium perchlorate, and 1% magnesium stearate would be prepared by standard dry process. The process includes mixing these components, followed by compaction and screening and finally pressing into formed pellets, preferably in the form as shown in FIGS. 2 and 3, by processing in an auger type aspirin press, modified to form the preferred pellet. The formed pellets are then tested by combusting a multiple pellet charge in the test device as previously described herein. The test inflators would include initiators loaded with 90 mg–270 mg ZPP. After ignition and burning, gaseous products of the combustion are analyzed. The approximate, expected 30 minute time averaged concentrations of the gaseous samplings in ppm by volume, are set forth in Table IIA below, as are determined by infrared spectroscopy:

TABLE IIA

| Concentration of Ignition Products for Example 2A (in ppm by volume) | |
|---|---|
| Carbon Monoxide | 100 |
| Carbon Dioxide | 1000 |
| Nitric Oxide | <1 |
| Nitrogen Dioxide | <1 |
| Nitrous Oxide | <1 |
| Ammonia | <1 |
| Hydrogen Cyamide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Sulfur Dioxide | <1 |
| Particulate | 0.1g |

EXAMPLE 2B

A gas generating composition containing, by weight, 88% ammonium nitrate, 6% polyethylene, 5% potassium perchlorate, and 1% magnesium stearate would be prepared by standard dry process. The process includes mixing these components, followed by compaction and screening and finally pressing into formed pellets, preferably in the form as shown in FIGS. 2 and 3, by processing in an auger type aspirin press, modified to form the preferred pellet. The formed pellets are then tested by combusting a multiple pellet charge in the test device as previously described herein. The test inflators would include initiators loaded with 90 mg–270 mg ZPP. After ignition and burning, gaseous products of the combustion are analyzed. The approximate, expected 30 minute time averaged concentrations of the gaseous samplings in ppm by volume, are set forth in Table IIB below, as are determined by infrared spectroscopy:

TABLE IIB

| Concentration of Ignition Products for Example 2B (in ppm by volume) | |
|---|---|
| Carbon Monoxide | 150 |
| Carbon Dioxide | 950 |
| Nitric Oxide | <1 |
| Nitrogen Dioxide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Sulfur Dioxide | <1 |
| Particulate | 0.2g |

EXAMPLE 3A

A gas generating composition containing, by weight, 92% ammonium nitrate, 6% purified paraffin wax, 1% RDX and 1% magnesium stearate would be prepared by standard dry process. The process includes mixing these components, followed by compaction and screening and finally pressing into formed pellets, preferably in the form as shown in FIGS. 2 and 3, by processing in an auger type aspirin press, modified to form the preferred pellet. The formed pellets are then tested by combusting a multiple pellet charge in the test device as previously described herein. The test inflators would include initiators loaded with 90 mg–270 mg ZPP. After ignition and burning, gaseous products of the combustion are analyzed. The approximate, expected 30 minute time averaged concentrations of the gaseous samplings in ppm by volume, are set forth in Table IIIA below, as are determined by infrared spectroscopy:

TABLE IIIA

| Concentration of Ignition Products for Example 3A (in ppm by volume) | |
|---|---|
| Carbon Monoxide | 100 |
| Carbon Dioxide | 1000 |
| Nitric Oxide | <1 |
| Nitrogen Dioxide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Sulfur Dioxide | <1 |
| Particulate | 0.1g |

EXAMPLE 3B

A gas generating composition containing, by weight, 92% ammonium nitrate, 6% polyethylene, 1% RDX, and 1% magnesium stearate would be prepared by standard dry process. The process includes mixing these components, followed by compaction and screening and finally pressing into formed pellets, preferably in the form as shown in FIGS. 2 and 3, by processing in an auger type aspirin press, modified to form the preferred pellet. The formed pellets are then tested by combusting a multiple pellet charge in the test device as previously described herein. The test inflators would include initiators loaded with 90 mg–270 mg ZPP. After ignition and burning, gaseous products of the combustion are analyzed. The approximate, expected 30 minute time averaged concentrations of the gaseous samplings in ppm by volume, are set forth in Table IIIB below, as are determined by infrared spectroscopy:

TABLE IIIB

| Concentration of Ignition Products for Example 3B (in ppm by volume) | |
|---|---|
| Carbon Monoxide | 150 |
| Carbon Dioxide | 950 |
| Nitric Oxide | <1 |
| Nitrogen Dioxide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |

TABLE IIIB-continued

| Concentration of Ignition Products for Example 3B (in ppm by volume) | |
|---|---|
| Other Hydrocarbons | <5 |
| Sulfur Dioxide | <1 |
| Particulate | 0.1g |

Additionally, other geometric forms of the gas generating composition could be utilized especially when the gas generator device is specifically configured to accommodate a varied form. Powdered or granular forms are also considered as alternatives to the preferred-formed pellet.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. A gas generating composition comprising in combination, by weight approximately 93% ammonium nitrate, approximately 1% magnesium stearate, and approximately 6% of a polyolefin paraffinic material selected from the group consisting of polyethylene, polypropylene, and polybutylene.

2. The gas generating composition of claim 1, wherein upon ignition, the generating composition substantially yields pure nitrogen gas, carbon dioxide and water.

3. A gas generating composition comprising in combination, by weight, approximately 88% ammonium nitrate, approximately 6% a paraffinic material, approximately 5% potassium perchlorate and approximately 1% magnesium stearate.

4. The gas generating composition of claim 3, wherein the paraffinic material is a polyolefin.

5. The gas generating composition of claim 4, wherein the polyolefin is selected from the group consisting of polyethylene, polypropylene, and polybutylene.

6. The gas generating composition of claim 3, wherein upon ignition, the generating composition substantially yields pure nitrogen gas, carbon dioxide and water.

7. A gas generating composition comprising in combination, by weight, approximately between 75% and 95% ammonium nitrate, approximately between 3% and 25% of a paraffinic material, approximately between 2% and 15% potassium perchlorate, and approximately 1% magnesium stearate.

8. The gas generating composition of claim 7, wherein the paraffinic material is a polyolefin.

9. The gas generating composition of claim 8, wherein the polyolefin is selected from the group consisting of polyethylene, polypropylene, and polybutylene.

10. The gas generating composition of claim 7, wherein upon ignition, the generating composition substantially yields pure nitrogen gas, carbon dioxide and water.

11. A gas generating composition comprising in combination, by weight, approximately between 75% and 95% ammonium nitrate, approximately between 3% and 25% of a paraffinic material, approximately between 0.5% and 5% RDX and approximately 1% magnesium stearate.

12. The gas generating composition of claim 7, wherein the paraffinic material is a polyolefin.

13. The gas generating composition of claim 8, wherein the polyolefin is selected from the group consisting of polyethylene, polypropylene, and polybutylene.

14. The gas generating composition of claim 7, wherein upon ignition, the generating composition substantially yields pure nitrogen gas, carbon dioxide and water.

* * * * *